United States Patent [19]

Lorscheid et al.

[11] 4,244,495

[45] Jan. 13, 1981

[54] PLASTIC LID SAFETY CLOSURE ASSEMBLY FOR CONTAINERS

[75] Inventors: Willy Lorscheid, Pulheim; Ludwig Wingen, Cologne, both of Fed. Rep. of Germany

[73] Assignee: Joachim Czech, Regensburg, Fed. Rep. of Germany

[21] Appl. No.: 40,497

[22] Filed: May 21, 1979

[30] Foreign Application Priority Data

Jun. 27, 1978 [DE] Fed. Rep. of Germany ..... 2828065

[51] Int. Cl.[3] ..... B65D 25/42

[52] U.S. Cl. ..... 222/153; 222/546; 222/556; 215/224; 220/281; 220/339

[58] Field of Search ..... 220/339, 306, 307, 375, 220/281; 215/209, 301, 224; 206/1.5; 222/153, 546, 556

[56] References Cited

U.S. PATENT DOCUMENTS

| | | | |
|---|---|---|---|
| 4,022,352 | 5/1977 | Pehr | 220/281 X |
| 4,042,105 | 8/1977 | Taylor | 215/209 X |
| 4,047,495 | 9/1977 | O'Brian | 220/281 X |
| 4,127,221 | 11/1978 | Vere | 220/306 X |
| 4,158,902 | 6/1979 | Chernack | 220/339 X |

*Primary Examiner*—George T. Hall

*Attorney, Agent, or Firm*—James E. Nilles

[57] ABSTRACT

A plastic lid closure assembly for containers, particularly for packaging purposes, comprising a lid and a lid carrier connected to one another by an integral web hinge, the lid carrier being formed with an upstanding resilient tongue and the lid being formed with a cam or the like adjacent the hinge and operative to transversely deform the resilient tongue on movement of the lid to produce a snap-up effect.

9 Claims, 6 Drawing Figures

PLASTIC LID SAFETY CLOSURE ASSEMBLY FOR CONTAINERS

BACKGROUND OF THE INVENTION

This invention relates to a plastic lid closure assembly for containers, particularly for packaging purposes, comprising a lid and a lid carrier connected to one another by an integral web hinge, said lid carrier being formed with an upstanding resilient tongue and said lid being formed with a cam or the like adjacent said hinge and operative to transversely deform said resilient tongue on movement of said lid to produce a snap-up effect.

Lid closure assemblies of this type are known from DE-GM No. 76 31 199 for use mainly in the packaging industry for sealing small containers such as bottles, cans and the like for packaging liquid products, particularly cosmetics, household detergents, pharmaceuticals and the like. In these known lid closure assemblies the lid carrier consists of a plastic closure cap adapted to be slipped or threaded onto a container and provided with a product dispensing opening which in the closed state of the lid is sealed by a plug formed integrally with the lid. Formed integrally with the lid carrier at an eccentric position thereto is an axially upstanding resilient tongue adapted to be laterally bent on closing or opening of the lid by rolling engagement with the cam or the like in order to assist opening and particularly the closing movement of the lid in its final stage by virtue of its resilient restoring force. The lid may be pivoted open, if desired, about an arc of 180°, and is then retained in its open position against inadvertent return movement to its closed position by the resilient tongue. The resilient tongue may be sufficiently thick-walled so as not to lose its effect even after use over a long period. The known plastic lid cover assembly to which the invention relates is generally characterized by simple structure and highly reliable operation, and lends itself to economical production with relatively simple injection molding tools.

SUMMARY OF THE INVENTION

It is an object of the invention to improve the lid closure assembly known from DE-GM No. 76 31 199 in an economically and technically simple manner for achieving substantial protection against inadvertent or inconsiderate opening of the lid, particularly by children. In this connection, the children's protection arrangement of the closure should be of highly reliable operation and preferably designed such as to permit the entire lid closure assembly to be economically produced as a one-piece injection molded body.

In order to achieve this object the invention provides that a locking device for locking the lid to the lid carrier in its closed position is provided at a position substantially opposite the web hinge, said locking device including an integrally formed locking member the locking engagement of which is relasable against a resilient restoring force by a lateral release force acting on the lid or the lid carrier.

In a preferred embodiment the invention provides that the lid is connected to the lid carrier by means of the web hinge for lateral movement relative thereto for releasing the safety locking device, so that in its closing position the lid may be slightly shifted transversely of the axis of the closure and the container relative to the lid carrier against the resilient restoring force of the portions forming the web hinge for releasing the locking device and thus permitting the lid to be tipped open. In this case, the web hinge is advantageously formed as a spring hinge adapted to be resiliently deformed by the lateral movement of the lid, which may be achieved by so-called undercutting of the portions forming the web hinge.

In another advantageous embodiment of the invention the arrangement may be selected such that the lid locking device may be released by resilient lateral deformation of the lid carrier wall adjacent the locking device. In this case it is preferred to select the wall thickness of the lid carrier adjacent the locking device somewhat smaller than along the remaining periphery of the lid carrier. For forming a diaphragm-like resilient pressure surface adjacent the locking device, the peripheral wall of the lid carrier is advantageously locally separated from the top wall thereof, so that the pressure surface may be resiliently deformed in a sufficient amount for releasing the locking device. Along the remaining periphery, however, the pressure surface should remain integrally connected with the peripheral wall of the lid carrier.

In the lid closure assembly according to the invention, locking of the lid is brought about by the closing movement of the lid, while the release of the locking device is caused by a releasing force acting transversely of the axis of the lid, the lid carrier and the container against a resilient restoring force either by shifting the lid in lateral direction relative to the lid carrier, or by forming the peripheral wall of the lid carrier adjacent the locking device as a pressure surface adapted to be resiliently pressed inwards against the locking member. These embodiments of the lid closure assembly result in a reliable and functionally safe locking of the lid in combination with a simple design of the locking device and the entire lid closure assembly which may therefore be formed as an economical injection-molded product. The locking device may be hidden within or underneath the closed lid. Releasing of the locking device and opening of the hinged lid may be performed by actuation with the fingers of only one hand.

The locking member is preferably formed integrally with the lid. In this case the lid holder may have a simple opening or the like in its upper surface, through which the preferably hook-shaped locking member extends. The lid carrier is preferably substantially cup-shaped, with the opening for the locking member being located in its top surface between the centrally located dispensing opening and the outer periphery. The lid carrier is preferably formed as a conventional closure cap adapted to be slipped or threaded onto a container. Preferably the lid is formed with a conventional plug extending from its underside for engagement with the dispensing opening of the container in the closed state of the lid. If the safety feature of the closure is designed such that the locking device is released by laterally shifting the lid relative to the lid carrier, the mentioned plug is preferably formed of an elastic material so as to permit lateral shifting of the lid by elastic deformation. For facilitating the opening movement of the lid it may be advantageous to provide a recess in the lid periphery adjacent the locking device. Further the bottom of the cup-shaped lid carrier is preferably formed with a centrally located axial inner sleeve for engagement with the throat portion of the container having the dispensing opening formed therein. At the hinge side the substantially cup-shaped lid carrier is preferably provided with a recess containing the upstanding resilient tongue, so that the resilient tongue over a portion of its length lies below the top surface of the lid carrier for achieving a sufficient length with relatively great elasticity.

THE FIGURES

Embodiments of the invention are shown in the accompanying drawings, in which

FIG. 1 shows an axial sectional view of a plastic lid closure assembly according to the invention with the lid closed and locked, FIG. 2 shows an axial sectional view of the lid closure assembly of FIG. 1 with the lid unlocked, FIG. 3 shows an axial sectional view of the lid closure assembly of FIGS. 1 and 2 with the lid open, and FIGS. 4 to 6 show axial sectional views of a second embodiment of the invention with the lid in different positions.

DESCRIPTION OF A PREFERRED EMBODIMENT

Figure 1:
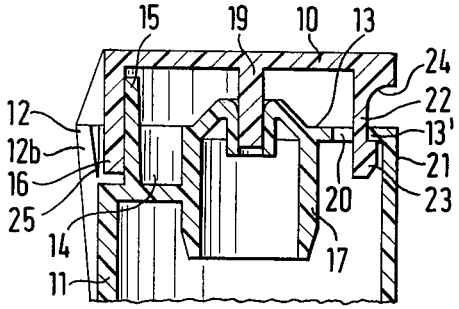
Figure 2:
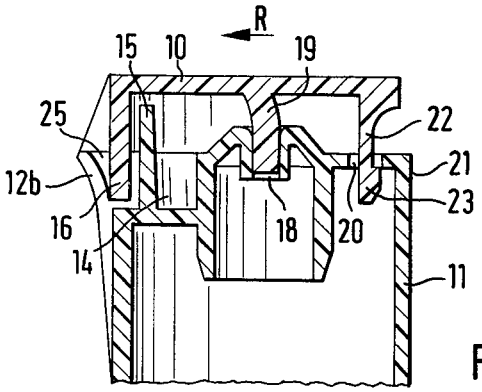
Figure 3:
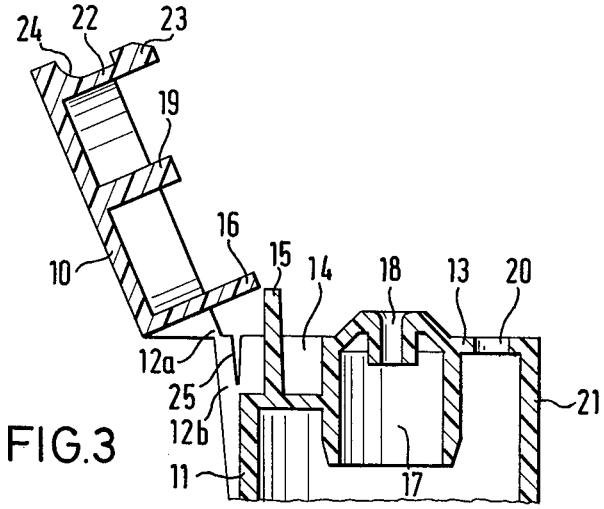

The lid closure assembly shown in FIGS. 1 to 3 has a circular lid 10 integrally connected to a cylindrical cup-shaped lid carrier 11 by a web hinge 12. The entire lid closure assembly is formed as a one-piece plastic injection molding. The web hinge 12 is formed, as known from DE-GM No. 76 31 199, by two parallel hinge strips each provided with a reduced cross-section portion 12*a* forming the actual hinge portion (FIG. 3). Formed in the top surface 13 of cup-shaped lid carrier 11 is a recess 14 containing an axially upstanding resilient tongue 15 located between the two portions of web hinge 12 as seen in the circumferential direction. The resilient tongue 15 is integrally formed with the lid carrier 11 with its axis extending parallel to the axis of the lid closure assembly and the container. The resilient tongue 15 is radially inwardly offset with respect to the periphery of the lid carrier 11. Formed integrally with the underside of lid 10 adjacent the hinge is a cam 16 cooperating with the upstanding resilient tongue in the manner known from DE-GM No. 76 31 199.

Integrally formed with the top surface 13 forming the bottom of cup-shaped lid carrier 11 is a central axially extending inner sleeve 17 containing the axial dispensing opening 18 of the container sealed in the closed state of lid 10 by a plug formed at the underside thereof. The lid carrier 11 has the form of a cap adapted to be slipped or threaded onto the neck portion of a container (not shown), so that the neck portion provided with the opening of the container sealingly engages the central inner sleeve 17 from below.

The top surface 13 of the lid carrier 11 is formed with a locking opening 20 opposite the hinge 12 between the centrally located dispensing opening 18 and the outer wall 21 of the lid carrier. At the corresponding location the lid 10 is provided with a downwardly extending hook-shaped locking member 22 formed integrally therewith. In the closed state of lid 10, locking member 22 extends through opening 20, so that its enlarged locking head 23 is engaged hook-fashion with a locking ledge 13' of the lid carrier to lock lid 10 in its closed position as shown in FIG. 1. Adjacent locking member 22 lid 10 is formed with a peripheral recess 24.

Web hinge 12 is formed as an undercut spring hinge. To this effect the hinge webs 12*b* formed integrally with the lid carrier are laterally separated therefrom by a substantially V-shaped incision 25 so as to act as spring members permitting lid 10 to be transversely shifted relative to lid carrier 11 in the direction of arrow R with resilient deformation of hinge webs 12*b*. The plug-shaped sealing member 19 of lid 10 is likewise resiliently deformable so as to accommodate the lateral shifting of lid 10, as shown in FIG. 2.

In FIG. 1 lid 10 is in its closed position, with cam 16 located within a peripheral recess of lid carrier 11 in engagement with resilient tongue 15. Locking member 22 extends through opening 20 so as to lock lid 10 to lid carrier 11. Opening of the lid is possible only after releasing the locking device. To this effect, lid 10 is shifted by finger pressure in the direction of arrow R until the engagement of hook-shaped locking head 23 is released as shown in FIG. 2. As already mentioned, this lateral shifting of lid 10 occurs against the resilient restoring force of the spring members 12*b* of web hinge 12, with the plug 19 engaging dispensing opening 18 accommodating the lateral displacement by its resilient deformation. After release of the locking device, lid 10 may be pivoted upwardly in its opening position shown in FIG. 3. During the opening movement of lid 10, the free edge of cam 16 slides along resilient tongue 15, so that the latter is laterally bent in the known manner. On closing of the lid 10 it is automatically locked by the locking member 22 entering opening 20 and being urged to its locking position by the restoring force of the web hinge formed as a spring hinge.

Figure 4:
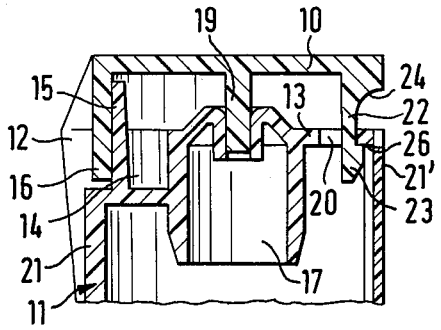
Figure 5:
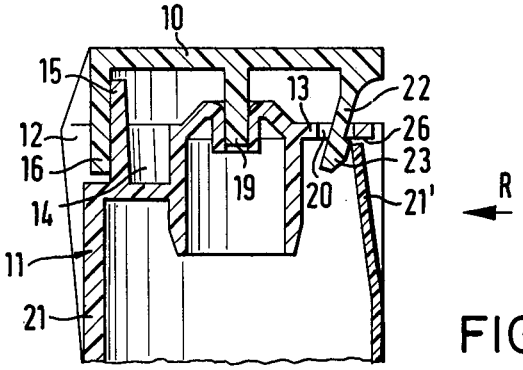
Figure 6:
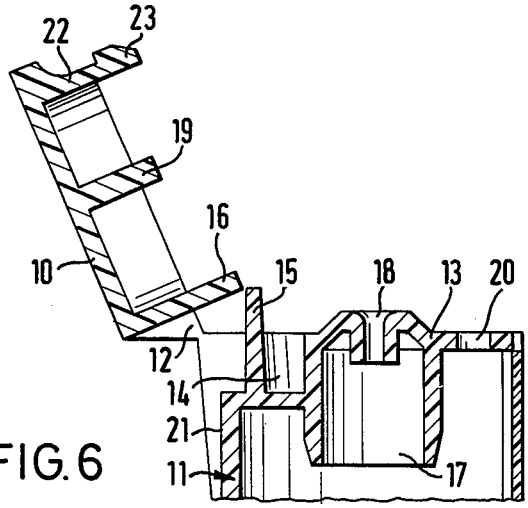

The lid closure assembly shown in FIGS. 4 to 6 largely corresponds to the embodiment shown in FIGS. 1 to 3. Identical parts are therefore designated by the same reference numerals. The sole difference lies in the design of means for releasing the locking device. In this embodiment, the locking device is released by resilient transverse deformation of a wall portion 21' of the cup shaped lid carrier 11 adjacent the locking device. At a positon diametrally opposite web hinge 12, the cylindrical peripheral wall 21 of lid carrier 11 is of considerably smaller thickness than along the remaining periphery, as clearly seen in FIGS. 4 to 6. Adjacent the locking device, the wall of the lid carrier thus forms a relatively thin, resilient, diaphragm-like pressure surface 21' adapted to be resiliently deformed in the direction of arrow R. For improving the elastic deformability of pressure surface 21', the peripheral wall 21 of lid carrier 11 is detached from the top wall 13 of the lid carrier as at 26, while in the circumferential direction pressure surface 21' is integrally connected to the remainder of peripheral wall 21.

For releasing the lid, the thin, resiliently deformable wall portion forming the pressure surface 21' is deformed inwardly by finger pressure as shown in FIG. 5, so that the hook-shaped locking member 22 of the lid is resiliently deformed until its locking head 23 is able to pass through opening 20 for upward movement of the lid 10 around web hinge 12 into its open position shown in FIG. 6. The pressure surface 21' and the locking member 22 then return to their original positions due to their resiliency. Closing of the lid causes the locking device to be automatically re-engaged. It is obvious that in the embodiment of FIGS. 4 to 6 the web hinge does not have to be formed as a spring hinge.

We claim:

1. A closure assembly for a container, of the type comprising a lid carrier which is receivable on the upper portion of the container to be substantially fixed thereon and wherein there is a hole through which contents of the container can be discharged, and a lid having a hinged connection with the lid carrier to be swingable to and from a closed position substantially overlying said lid carrier and blocking said hole, said closure assembly being characterized by:

A. said lid having thereon a substantially hook-shaped locking member, said locking member
(1) projecting downwardly from the lid relative to said closed position thereof,
(2) being near the periphery of the lid at a location substantially opposite said hinge connection, and
(3) having thereon a shoulder which projects away from the hinge connection and defines a surface that is spaced below the lid and faces toward the same;

B. said lid carrier having thereon, at a location which is near its periphery and substantially opposite said hinge connection, a radially inwardly projecting ledge under which said shoulder is releasably engageable to confine the lid in its closed position;

C. cooperating means on said lid and the lid carrier by which said locking member is normally maintained in a position in which said shoulder is engaged under said ledge but providing for resiliently yielding displacement of at least the lower portion of said locking member in the direction towards the hinge connection to enable disengagement of said shoulder from said ledge for opening of the lid; and D. said lid having a peripheral portion which
(1) is opposite said hinge connection and
(2) overlies the peripheral portion of the lid carrier to be engageable by a thumb for swinging the lid away from its closed position at the same time that said thumb is applying force in a direction towards said hinge connection to effect disengagement of said shoulder from said ledge.

2. The closure assembly of claim 1 further characterized by:

E. said locking member being formed integrally with said lid of a substantially resilient material.

3. The closure assembly of claim 1 wherein said lid carrier has a top wall portion in which there is an aperture through which said locking member projects downwardly when the lid is in its closed position, said ledge being defined by an edge portion of said aperture.

4. The closure assembly of claim 1 wherein said hinge connection comprises a web hinge that is integral with said lid carrier and said lid and which is arranged to permit the lid, when it is in its closed position, to have lateral movement in the direction towards the hinge connection to provide for disengagement of said shoulder from said ledge.

5. The closure assembly of claim 4 wherein said web hinge comprises a spring hinge which is resiliently deformable and which comprises said cooperating means on the lid and the lid carrier.

6. The closure assembly of claim 1 further characterized by:

said lid carrier having a substantially upright wall portion which is adjacent to said ledge and which is radially inwardly deformable for application of force therethrough to the lower portion of said locking member by which the shoulder thereon can be released from said ledge.

7. The closure assembly of claim 1 further characterized by:

said lid being formed with an integral downwardly projecting plug which is resiliently deformable laterally and which, relative to the closed position of the lid, is receivable in a dispensing opening in the lid carrier.

8. The closure assembly of claim 1, further characterized by:

said lid having a peripheral recess under said peripheral portion thereof.

9. The closure assembly of claim 7 wherein said lid carrier has a top wall in which said dispensing opening is formed, further characterized by:

(1) said lid carrier further having a central sleeve portion projecting downwardly from its said top wall, in surrounding relation to said despensing opening, to be received with a close fit inside the neck of a container onto which the lid carrier is secured; and (2) said top wall having therein an aperture which is at the side of said dispensing opening that is remote from said hinge connection and through which said locking member projects downwardly when the lid is in its closed position, said ledge being defined by an edge portion of said aperture.

* * * * *